US005926904A

United States Patent [19]

Warner

[11] Patent Number: 5,926,904

[45] Date of Patent: Jul. 27, 1999

[54] TWISTED TUFT BRUSH AND METHOD OF MAKING

[75] Inventor: Rueben Brown Warner, Westlake, Ohio

[73] Assignee: Jason Incorporated, Cleveland, Ohio

[21] Appl. No.: 08/540,078

[22] Filed: Oct. 6, 1995

[51] Int. Cl.[6] ..... A46B 3/00

[52] U.S. Cl. ..... 15/179; 15/198; 15/200; 15/205; 15/207.2

[58] Field of Search ..... 15/179, 182, 197, 15/198, 200, 204, 205, 206, 207.2

[56] References Cited

U.S. PATENT DOCUMENTS

| | | | |
|---|---|---|---|
| 1,493,670 | 5/1924 | Galvin | 15/179 |
| 1,633,274 | 6/1927 | Rasmesen, Jr. | 15/179 |
| 2,278,928 | 4/1942 | Herold | 15/198 |
| 2,755,496 | 7/1956 | Benyak | 15/198 |
| 3,068,504 | 12/1962 | Peterson | 15/198 |
| 3,147,503 | 9/1964 | Charvat | 15/179 |
| 3,382,521 | 5/1968 | Holder et al. | 15/198 |
| 4,010,308 | 3/1977 | Wiczer | 15/207.2 |
| 4,488,760 | 12/1984 | Weiler | 15/181 |
| 5,490,529 | 2/1996 | Fitjer | 15/206 |

*Primary Examiner*—Denise L. Ferensic
*Assistant Examiner*—James F. Hook
*Attorney, Agent, or Firm*—Renner, Otto, Boisselle, Sklar

[57] ABSTRACT

An abrading tool or brush is formed with an open center low density tuft. The tufts are laterally slightly compressed and encapsulated in a medium density elastomeric foam reinforcement having a density of from about 20 to about 50 lbs/cu/ft (320–800.90 Kg/cu. meter). When the tufts are formed, preferably of wire, they are twisted about a core extending axially of the tufts. The core includes angled facets which form corners around which the wire is bent to form closely spaced bends to promote short fracture of the wire in use.

16 Claims, 2 Drawing Sheets

TWISTED TUFT BRUSH AND METHOD OF MAKING

DISCLOSURE

This invention relates generally as indicated to a twisted tuft brush and method, and more particularly to a foamed elastomer encapsulated brush of the twisted wire knot type, and to a method of making such brush.

BACKGROUND OF THE INVENTION

Twisted tuft or knot type wire brushes, whether of the wheel or cup type, have long been employed. Examples may be seen in Peterson U.S. Pat. Nos. 2,929,086, 2,866,989, and 2,826,776. In this well known type of brush, bundles of wire are inserted through equally circumferentially spaced holes in an annulus or within a retaining ring. The tufts are folded to extend radially and then twisted on themselves to form a twisted knot type brush. The tufts, whether one or a few turns, or many, are twisted as tight as possible, both to secure the wire in place to the annulus or ring, but also to cause the wires mutually to reinforce each other, both within the twisted tuft or knot, and adjacent knots. One of the principal advantages of this type of tool is that the working tips of the wires or filaments each point in a slightly different direction, providing an aggressive cutting, deburring or abrading action.

Such tools have a few disadvantages. One is that they require a lot of what can be expensive wire. They are costly to make correctly, and they suffer from wire fatigue and fracture. Moreover, it is difficult to control and maintain uniform wire point distribution. Where a narrow brush face is desired, the tufts are twisted tight to their working tips providing radially separating tight narrow bundles. To provide a wider more dense face, several rows with fewer twists may be provided. The distribution at the working face is still a problem. While the wire tip may be pointing in the right direction to do the job, if it is too easily laterally deflected or insufficiently supported, it may miss its opportunity. Accordingly, it would be desirable to provide a lower cost twisted tuft or knot type wire brush and yet with a more uniform and better supported wire tip working face.

Foamed elastomers have long been used to improve the working action of rotary brushes. Examples are the wide line of TY® brushes sold by Osborn Manufacturing of Cleveland, Ohio. A more recent example is seen in Schneider et al. U.S. Pat. Nos. 4,945,687 and 5,046,288.

Attempts to provide the advantages of a foamed elastomer matrix to a twisted tuft or knot type brush have failed, perhaps for a variety of reasons. The principal reason is the tuft or knot form of the tool. The tuft form and material viscosities do not allow the elastomer to penetrate the tight twist or knot. The elastomer is instead concentrated at the sides between the tufts or knots and often times in isolated pockets which may tend to break out or become dislodged during use. Abrasives or fillers in the elastomers designed to erode the elastomer in use do not get where they can do some good and just make the unwanted disintegration problem worse. An elastomer useful in a twisted tuft or knot tool needs to have a high tensile strength, low viscosity and an appropriate hardness level. The elastomer also needs good thermal stability.

It would, accordingly, be desirable to have a twisted tuft or knot type brush where the advantages of a foamed elastomer matrix could be employed to provide more uniform wire point distribution with good requisite lateral support and control, all at a lower cost.

SUMMARY OF THE INVENTION

With the present invention, the wire tufting or knotting has been altered to permit uniform penetration and distribution of the foamed elastomer reinforcing matrix. Instead of twisting the knot or tuft as tight as possible, the tuft or knot is formed with a significantly reduced wire count, and the tufts are formed with a hollow core or center. A reduction of over a third or more in the number of the wires provides a lower density tuft which is twisted around a rod or pin extending axially of the tuft. This forms the hollow or open core of the tuft. The rod may be provided with flats or corners in effect to bend or crimp the wire as it is twisted. The corners bend the wire at fairly closely spaced locations as it spirals around the core. This promotes short fracture of the wire as the wire tip and elastomer tool face wears away in use. To provide such faces and bend angles, the core about which the wire is twisted may be triangular, square or hexagonal, for example.

When the loose or open center knots are formed on an annulus such as a disc or ring, the resulting tool has little stability. The hollow or open center tufts are loose on the annulus and have considerable lateral spread or openness.

The resulting loose tuft tool is then placed in a mold, the side walls of which laterally confine the open tufts. In other words, the wires contact the mold walls and the mold actually somewhat laterally compresses the loose or open tuft. The mold embraces the entire tuft from the annulus outwardly to the wire tips. An elastomer having improved tensile strength is injected into the mold and foamed to provide a foam having the requisite hardness and tensile strength, and a density of preferably from about 20 to about 50 lbs/cu/ft (320.36–800.90 Kg/cu. meter).

When the tool is removed from the mold, it will have a relatively more narrow uniform width tool face with uniform distribution of the wires. The wires which contacted the mold plates will be exposed at the sides of the reinforcing foam matrix. This exposes substantial amounts the wire to the air or coolant and enables the tool to run considerably cooler. In some applications, the tool may be used without liquid coolant. More importantly, the foamed elastomer completely penetrates the loose or hollow core tuft or knot and each wire filament is not only properly supported but kept cooler. By reducing the wire count up to 60%, and preferably by about one third, for example, the cost of the tool can be significantly reduced, while the operation of the tool and its performance is significantly improved.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
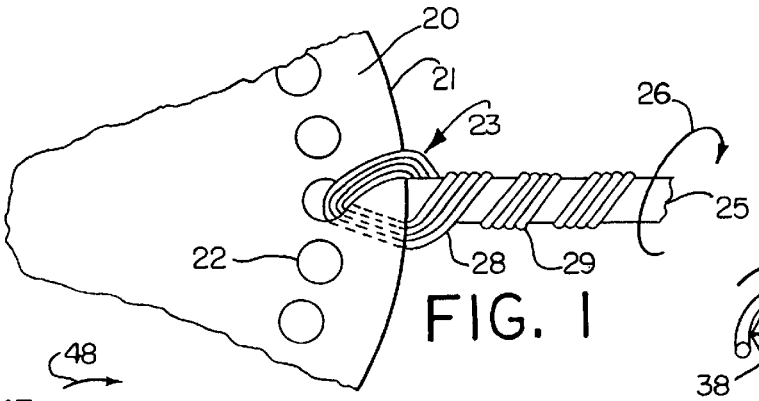
FIG. 1 is a fragmentary illustration of a hollow twisted tuft being formed.
Figure 8:
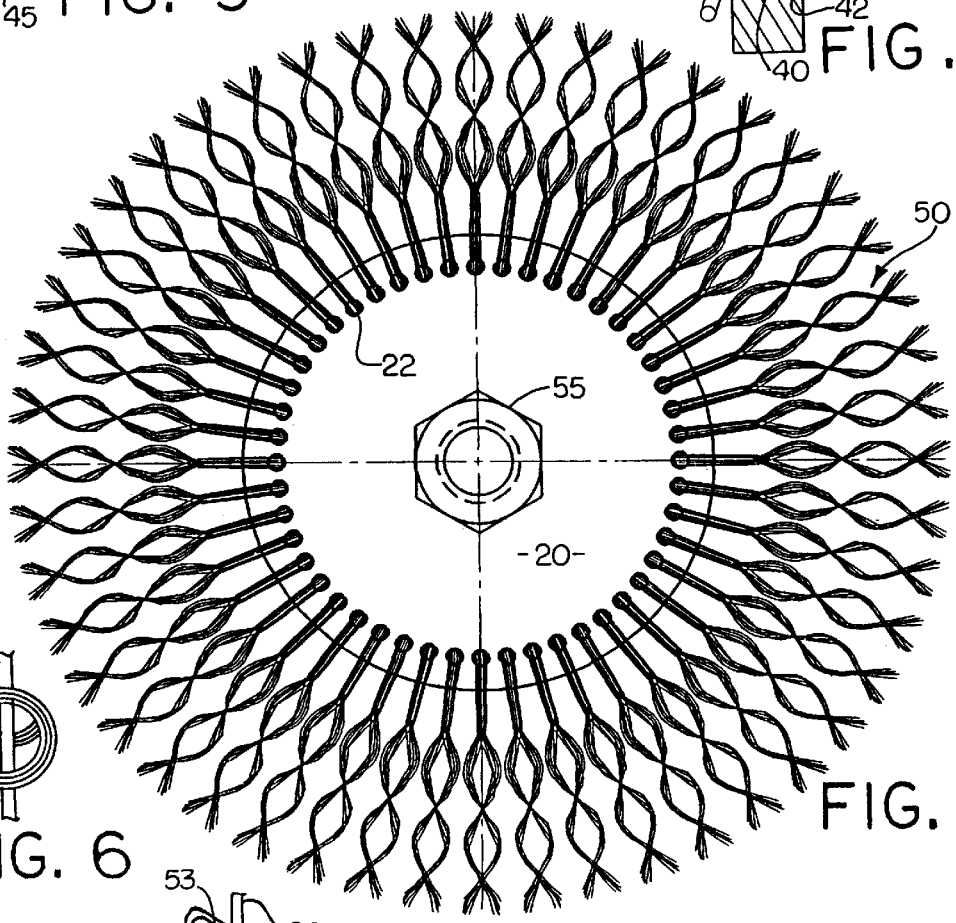
FIG. 8 is an axial elevation of a wheel annulus of an intermediate tool.

Referring initially to FIG. 1, and also FIGS. 6, 7, 8 and 9, it will be seen that the brush of the present invention has a disc hub 20 which includes an annular outer edge 21 and a series of equally circumferentially spaced holes 22 around the edge. To form a wheel brush such as seen in FIG. 8, a bundle of filaments, preferably wires, is inserted through each hole 22 and then folded to extend radially. The bundle is shown at 23. Although only four wires are shown in the bundle, it will be appreciated that the number may be more than four, but in any event, significantly reduced from the number of wires which would form a normal twisted tuft or knot type wire brush. Normally, the number of wire filaments would significantly fill the hole 22. As indicated, up to 60% fewer wires may be employed, and preferably approximately one third (⅓) the wire count of a normal twisted tuft or wire knot brush is employed.

After the bundle has been inserted through each hole and folded to extend radially, the bundle is wrapped around a core rod or pin shown generally at 25 which extends radially of the disc or annulus 20. The core is rotated about its axis in the direction of the arrow 26 and the two legs of the filament bundle are spirally wrapped around the core as indicated at 28 and 29. After the bundle has been tightly wrapped as indicated, the core 25 is removed.

Figure 2:
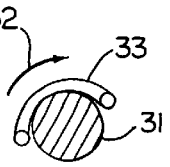
FIGS. 2–5 are transverse sectional views of various core rods which may be used to crimp the wire as it is twisted to form the hollow tuft.
Figure 3:
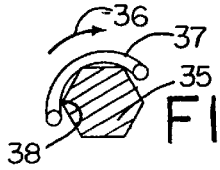

In FIG. 2, there is illustrated a circular-in-section core rod 31. When the core is rotated in the direction of the arrow 32, the wire shown at 33 is simply wrapped around as indicated. In FIG. 3, there is illustrated a hexagonal-in-section core 35. When rotated in the direction of the arrow 36, the wire shown at 37 is engaged by the relatively sharp corners 38 which form a crimp or bend in the wire to promote short fracture of the wire at the spacing location of the corners.

Figure 5:
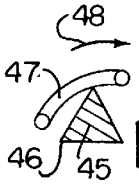
Figure 4:
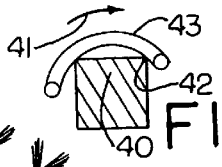

A square-in-section core rod is shown at 40 in FIG. 4 and when rotated in the direction of the arrow 41, the somewhat sharper corners 42 engage the wire 43 to provide the closely spaced or crimp bend points. In FIG. 5, there is shown a triangular core 45 which has sharper still corners 46 and which corners engage the wire 47 when the core is rotated in the direction of the arrow 48.

Figure 6:
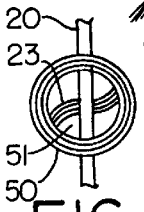
FIG. 6 is an axial view of the open tuft.

As seen in FIG. 6, the wire bundle 23 wrapped around a circular core 31 has a cylindrical configuration such as seen at 50 when viewed axially. The twisted tuft also has a hollow or open core 51 when viewed axially.

Figure 7:
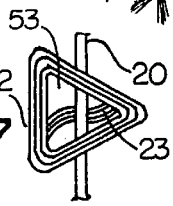
FIG. 7 is an axial view of a open tuft made with a triangular core as seen in FIG. 5.

As seen in FIG. 7, if a triangular core 45 is employed, the tuft 52 formed has the triangular axial configuration shown with a hollow triangular interior 53.

Figure 9:
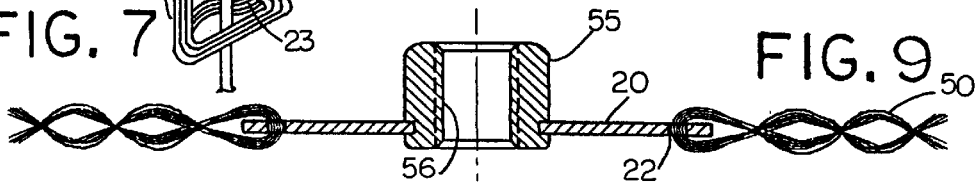
FIG. 9 is a diametral section of the wheel tool of FIG. 8.

After each tuft is formed as seen in FIGS. 8 and 9, an annular radially extending array of hollow tufts 50 are formed extending from the disc 20 from each hole 22.

The intermediate wheel tool seen in FIGS. 8 and 9 is a rather loose and an unstable agglomeration of a radial array of open, low density twisted tufts, since the reduced wire count tufts are not twisted tight either on themselves or on the outer edge of the disc. The interior of the disc is provided with an axially extending hexagonal hub 55 which has internal threads 56.

Figure 10:
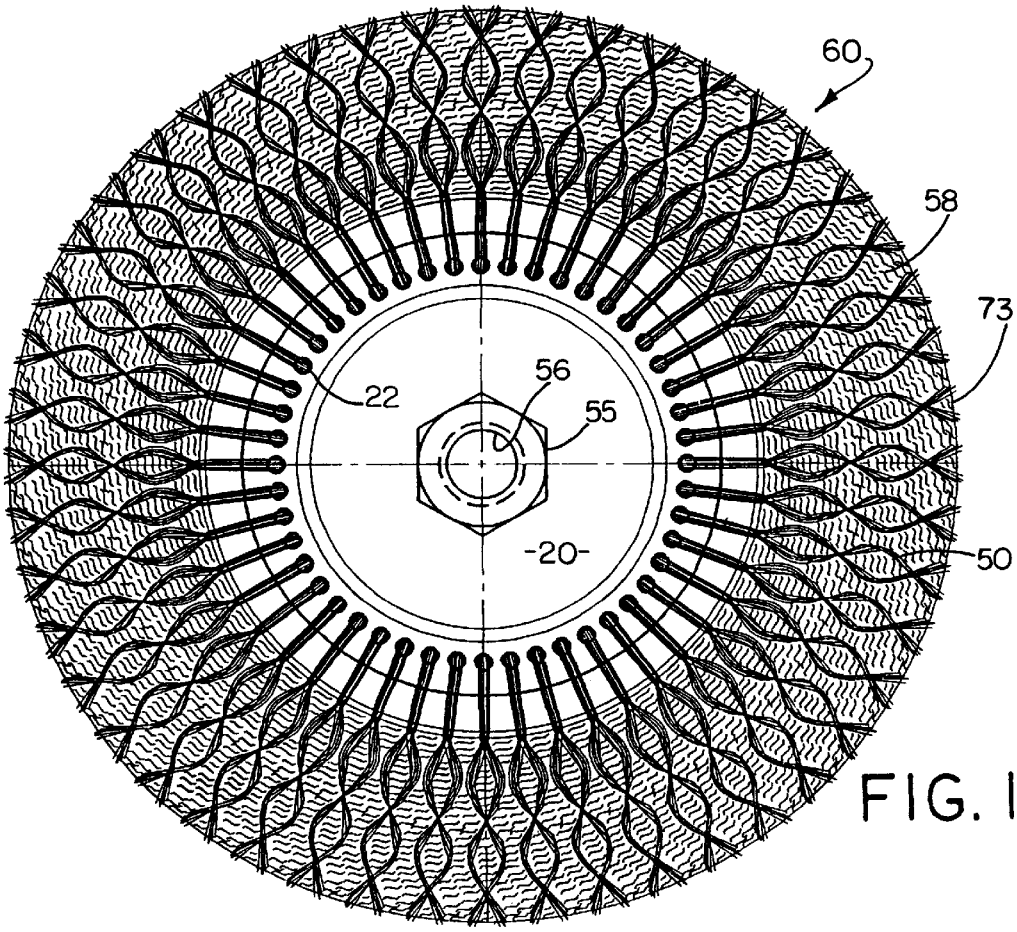
FIG. 10 is a view like FIG. 8 showing the tool after foam encapsulation.
Figure 11:
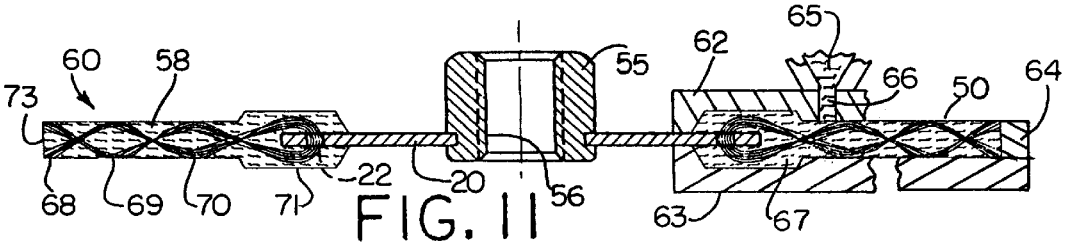
FIG. 11 is a view like FIG. 9 illustrating foam encapsulation with the mold walls on one side shown broken away.

Referring now to FIGS. 10 and 11, it will be seen that the radially extending array of open twisted tufts 50 is encapsulated in a foam elastomer reinforcement indicated at 58, to form the finished wheel-type tool 60 seen in FIG. 10.

As seen in FIG. 11, in order to form the reinforcement, the radially extending array of open tufts is enclosed by annular mold plates seen at 62 and 63. The mold plates bear against the disc 20 at their radial inner ends and are separated by a ring 64 at their radial outer ends at the tips of the open twisted tuft filaments. Foamable elastomer indicated at 65 is injected through sprue hole 66 completely to fill the mold cavity as indicated at 67. The viscosity of the foamable elastomer is such as to completely fill the mold and also the hollow interiors of the open tufts.

When the mold plates close to the position seen in FIG. 11, they laterally compress the open tufts so that a significant amount of the wire filaments as indicated at 68, 69, 70, and even 71 actually abut against the interior of the mold plates and when the elastomer has foamed and cured. After the mold plates are open, the wires at such points are exposed. More importantly, the somewhat lateral compression of the open filaments organizes and contains the tip of the filaments as indicated at 73, providing a more uniform and better supported wire tip working face.

As will be hereinafter described, the foam elastomer is provided with abrasive, if desired, and an erodible filler which permits the reinforcement to wear back in use maintaining the projecting tip of the filaments in an organized fashion so that when rotated, the wheel tool of the present invention provides an aggressive working face with each filament projecting slightly from the reinforcement in a slightly different direction. When the mold plates are removed, the wheel tool is as shown in FIG. 10, or FIG. 11, without the mold plates.

Figure 12:
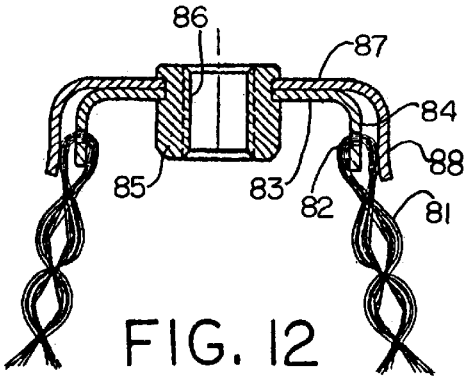
FIG. 12 is a section of an intermediate cup form tool.
Figure 13:
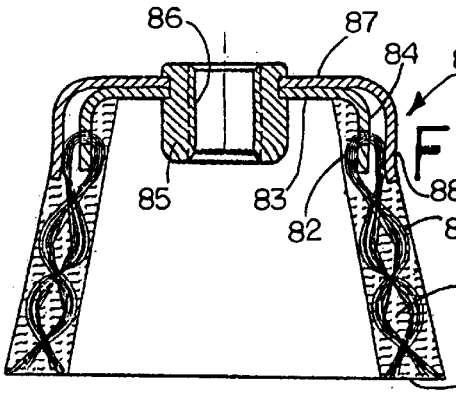
FIG. 13 is a view of the same tool after encapsulation.

Referring now to FIGS. 12 and 13, it will be seen that a very similar process may be employed to form a cup brush as seen at 80 in FIG. 13. The open tufts 81 are formed through holes 82 in disc 83, the circumferential edge of which has been bent to extend axially as indicated at 84. The hexagonal hub 85 is provided with internal threads 86 and a second backing disc 87 is secured to the hub which is formed to extend axially as indicated at 88. The loose tuft intermediate tool having the open core twisted or knotted tufts with a reduced wire count is then placed between conical mold walls for injection of the elastomeric foam reinforcement seen in FIG. 13 at 90. The elastomeric foam completely fills the interior of the open tufts and provides a cup-shape tool 80 having an axially projecting working face 91.

The foamed thermoplastic elastomers of the present invention are prepared from thermoplastic elastomers having high tensile strength, good heat resistance, high hardness, and low viscosity. The foams generally have a density from about 10 (160.18), or preferably from about 20 (320.36) pounds per cubic feet to about 60 (961.08), or preferably to about 50 (800.90) pounds per cubic feet (Kg/cu. meter). Specific examples of thermoplastic elastomers used to prepare the foams of the claimed invention include, but are not limited to thermoplastic polyurethane elastomers (TPU), chlorosulfonated polyethylene elastomer, polyester elastomers, polyether block amide thermoplastic elastomers (PEBA), ionomeric thermoplastic elastomers, polyesteramide (PEA) or polyether esteramide (PEEA) elastomers and copolymers or blends thereof including those polymer mixtures which are physically continuous or blends which have two or more discrete phases.

Polyurethane elastomers are formed from the polymerization of selected diisocyanates, such as toluene diisocyanates (TDI), both 2,4 and 2,6 isomers, or 4,4'-diphenylmethane diisocyanate (MDI), with hydroxyl terminated polyesters or hydroxyl terminated polyethers and chain extenders. The resulting block co-polymer has hard segments and soft segments. The hard segments being polyurethane bridges with a chain extender such as a polyol and soft segments of polyester or polyether. As is known in the art, other materials may be added to either side of the polyurethane bridge to impart a wide variety of properties to the polyurethanes. The polyurethane elastomers have good heat resistance, having a service temperature up to about 250° F. (121° C.). This heat range may be extended up to about 300° F. (149° C.) by the addition of epoxides or isocyanurates to the polyurethane backbone. Also, variation of the hard segment content allows variation of the hardness and glass transition temperature of the elastomer. Generally, the harder the polyurethane, i.e., more isocyanate and chain extender content, the higher the service temperature. The polyurethanes have high tensile strength and abrasion resistance with polyester based polyurethanes generally offering the best mechanical properties.

Chlorosulfonated polyethylene elastomers, known commonly as Hypalon, available from DuPont, are prepared by substituting chlorine and sulfonyl chloride groups into polyethylene. Generally, the elastomer contains about one third chlorine and about 1% to about 2% sulfur. This elastomer is characterized by excellent temperature and abrasion resistance, and good mechanical properties including tensile strength. The elastomer may be used alone or blended with other elastomers to provide improved properties.

The polyester thermoplastic elastomers useful in the present invention are generally block copolymers having hard segments of alkylene terephthalate units and soft segments of long chain poly(alkylene oxide)s that have been esterified to phthalates. The elastomers are generally prepared from terephthalic acids and isomers thereof and poly (alkylene oxide glycols) from ethylene oxide, propylene oxide, tetramethylene oxide and their copolymers. Typically, the hard segments are composed of multiple short chain ester units such as tetramethylene terephthalate units derived from terephthalic acid and tetramethylene glycol. The soft segments are derived from aliphatic polyether or polyester glycols such as poly(ethylene oxide) glycol. The polyester elastomers are characterized by a wide range of values of heat resistance and mechanical properties. Consequently, the elastomer composition can be varied to have the heat and mechanical characteristics recited above.

The polyether block amide (PEBA) thermoplastic elastomers useful in the present invention are prepared from block copolymerization of polyether diol blocks and dicarboxylic polyamide blocks. The copolymerization reaction is a polyesterification reaction. The dicarboxylic polyamide blocks are prepared from a reaction of a polyamide precursor such as amino acids, lactams, dicarboxylic acids, and diamines with a dicarboxylic acid chain limitor. The polyether blocks are prepared by anionic polymerization of ethylene oxide or propylene oxide or cationic polymerization of tetrahydrofuran. The elastomers are characterized as having excellent mechanical properties and, with heat stabilization additives, good thermal resistance.

The ionomeric thermoplastic elastomers useful in the present invention are generally prepared by the reaction of a functionalized monomer such as acrylic acid, methacrylic acid, vinyl acetate, and the like and copolymers thereof, with an olefinic unsaturated monomer such as ethylene, propylene, butadiene, styrene, copolymers thereof and the like. The elastomers have ionic cross linking, for instance with Na, Zn, K, Li, Mg, Sr, and Pb, which results in neutralization of some of the acid moieties of the functionalized monomer. The elastomers exhibit excellent mechanical properties and heat resistance.

Polyesteramides (PEA) and polyether-esteramides (PEEA) are segmented block copolymers having hard segments based on partially aromatic amides and soft segments of aliphatic polyesters (PEA) or aliphatic polyethers linked to the hard segment by an ester group. PEA and PEEA are prepared from the condensation reaction of 4,4'-diphenylmethane diisocyanate (MDI) with dicarboxylic acids and a carboxylic acid terminated polyester or polyether prepolymer. The prepared elastomers are characterized by high temperature tensile properties and good abrasion resistance.

The foamed elastomer may incorporate powder or granular fillers or abrasives. Although the tool of the present invention is principally a twisted tuft brush, it will be appreciated that fillers or abrasives may be delivered to the working face by incorporation in the reinforcing elastomer foam, both to enhance the abrading or finishing work being done, but also to promote uniform erosion of the reinforcement as the tool wears. Such fillers also improve heat characteristics and reduce smearing. Examples of useful fillers and abrasives are silica powders, olivine, silicon carbide, pumice, garnet, emery, carborundum, aluminum oxides, tungsten carbide, boron nitride, and even more exotic abrasives such as zirconium alumina or synthetic diamonds.

It can now be seen that there is provided a wire tuft tool which has an open or hollow core permitting uniform penetration and distribution of a foam elastomer reinforcing matrix. When the knot or tuft is formed, the reduced wire count is formed with a hollow core or center. Although the reduced wire count may be as high as 60%, approximately ⅓ is preferred. The reduced wire count and the open core provide a lower density tuft which is twisted around a rod or core axially of the tuft. The rod may be provided with flats or corners to bend or crimp the wire as it is twisted to promote sure fracture of the wire as the tip and elastomer tool face wear away. The resulting intermediate tool enables the complete tool from the hub to the working tip face to be effectively encapsulated in a foam elastomer matrix which completely fills the open cores and embraces the wires. In the formation of the tools, the open tuft is compressed somewhat so that a significant portion of the filament or wire count is exposed at the outside of the matrix, thus promoting cooling of the tool in operation.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

What is claimed is:

1. A rotary tool comprising a hub, a plurality of low density hollow open center twisted tufts projecting from said hub, said hollow open center of each tuft having an axis extending axially of the tuft and around which axis the tuft is twisted, and an erodible medium density elastomeric foam encapsulating said twisted tufts and filling said hollow open centers thereof.

2. A rotary tool as set forth in claim 1 wherein said encapsulated tufts project from the hub in the form of a wheel.

3. A rotary tool as set forth in claim 1 wherein said encapsulated tufts project from said hub in the form of a cup.

4. A rotary tool as set forth in claim 1 wherein said twisted tufts are made of wire.

5. A rotary tool as set forth in claim 4 wherein said wires each include closely spaced bends to promote short fracture as the elastomeric foam erodes.

6. A rotary tool as set forth in claim 4 wherein the wire count of each tuft is reduced from the normal wire count for making a tight twisted tuft.

7. A rotary tool as set forth in claim 6 wherein said wire count is reduced by approximately one third.

8. A rotary tool as set forth in claim 1 wherein said twisted tufts are made of wire, and said wire is exposed at the tips of the tufts and at the sides of the foam encapsulation.

9. A rotary tool as set forth in claim 8 wherein said hollow open center twisted tufts are compressed axially of the hub and said wire is exposed through the foam encapsulation.

10. A rotary tool as set forth in claim 1 wherein said elastomeric foam encapsulation has a density of from about 20 to about 50 lbs/cu/ft.

11. A rotary tool as set forth in claim 10 wherein said elastomer foam encapsulation is selected from the group consisting essentially of thermoplastic polyurethane elastomers, chlorosulfonated polyethylene elastomers, polyester elastomers, polyether block amide elastomers, ionomeric elastomers, polyesteramide or polyether esteramide elastomers, and copolymers or blends thereof.

12. A rotary tool as set forth in claim 10 wherein said foam encapsulation includes fillers to promote erosion.

13. A rotary tool as set forth in claim 12 wherein said foam encapsulation includes an abrasive additive homogeneously mixed throughout the foam.

14. A rotary tool as set forth in claim 1 wherein said hub is a rotary disc having peripheral holes through which said tufts extend.

15. A rotary tool as set forth in claim 14 wherein said disc is shaped as a cup so that said twisted tufts extend generally axially of the rotary disc.

16. A rotary tool as set forth in claim 1 wherein said elastomeric foam encapsulating said twisted tufts and filling said hollow open centers has a density of from about 10 to about 60 pounds per cubic foot.

* * * * *